US010400576B2

(12) United States Patent
Bayer

(10) Patent No.: US 10,400,576 B2
(45) Date of Patent: Sep. 3, 2019

(54) METHOD FOR INTRODUCING A BOREHOLE INTO THE SOIL AND SOIL DRILLING DEVICE AND USE THEREOF

(71) Applicant: TRACTO-TECHNIK GmbH & Co. KG, Lennestadt (DE)

(72) Inventor: Hans-Joachim Bayer, Kohlberg (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 15/446,621

(22) Filed: Mar. 1, 2017

(65) Prior Publication Data

US 2017/0254192 A1 Sep. 7, 2017

(30) Foreign Application Priority Data

Mar. 3, 2016 (DE) ..... 10 2016 002 479

(51) Int. Cl.

| | |
|---|---|
| ***E21B 47/024*** | (2006.01) |
| ***E21B 47/09*** | (2012.01) |
| ***E21B 47/022*** | (2012.01) |
| *E21B 7/04* | (2006.01) |

(52) U.S. Cl.

CPC ..... *E21B 47/024* (2013.01); *E21B 47/02216* (2013.01); *E21B 47/0905* (2013.01); *E21B 7/046* (2013.01)

(58) Field of Classification Search

CPC ..... E21B 47/024; E21B 47/0905; E21B 47/02216

See application file for complete search history.

(56) References Cited

U.S. PATENT DOCUMENTS

| | | | | |
|---|---|---|---|---|
| 4,016,942 | A | 4/1977 | Wallis, Jr. et al. | |
| 2006/0124360 | A1* | 6/2006 | Lee | E21B 43/305 175/61 |
| 2008/0041626 | A1 | 2/2008 | Clark | |
| 2010/0224415 | A1 | 9/2010 | Lee et al. | |
| 2012/0006597 | A1* | 1/2012 | Boike | E21B 7/046 175/45 |
| 2015/0331139 | A1* | 11/2015 | San Martin | E21B 47/02216 324/339 |

FOREIGN PATENT DOCUMENTS

| | | | |
|---|---|---|---|
| DE | 10309144 | A1 | 11/2003 |
| JP | H0372194 | A | 3/1991 |
| JP | H0372195 | A | 3/1991 |
| JP | H11183636 | A | 7/1999 |
| JP | 2010059678 | A | 3/2010 |
| JP | 2011522141 | A | 7/2011 |
| WO | 2014098891 | A1 | 6/2014 |

* cited by examiner

*Primary Examiner* — Kristyn A Hall

(74) *Attorney, Agent, or Firm* — Howard IP Law Group

(57) ABSTRACT

A method for introducing a borehole into the ground includes advancing at least two drill heads, detecting one of the two drill heads is detected by a detection unit on the other drill head, and adapting the direction of advance of at least one of the drill heads relative to the other drill head.

20 Claims, 1 Drawing Sheet

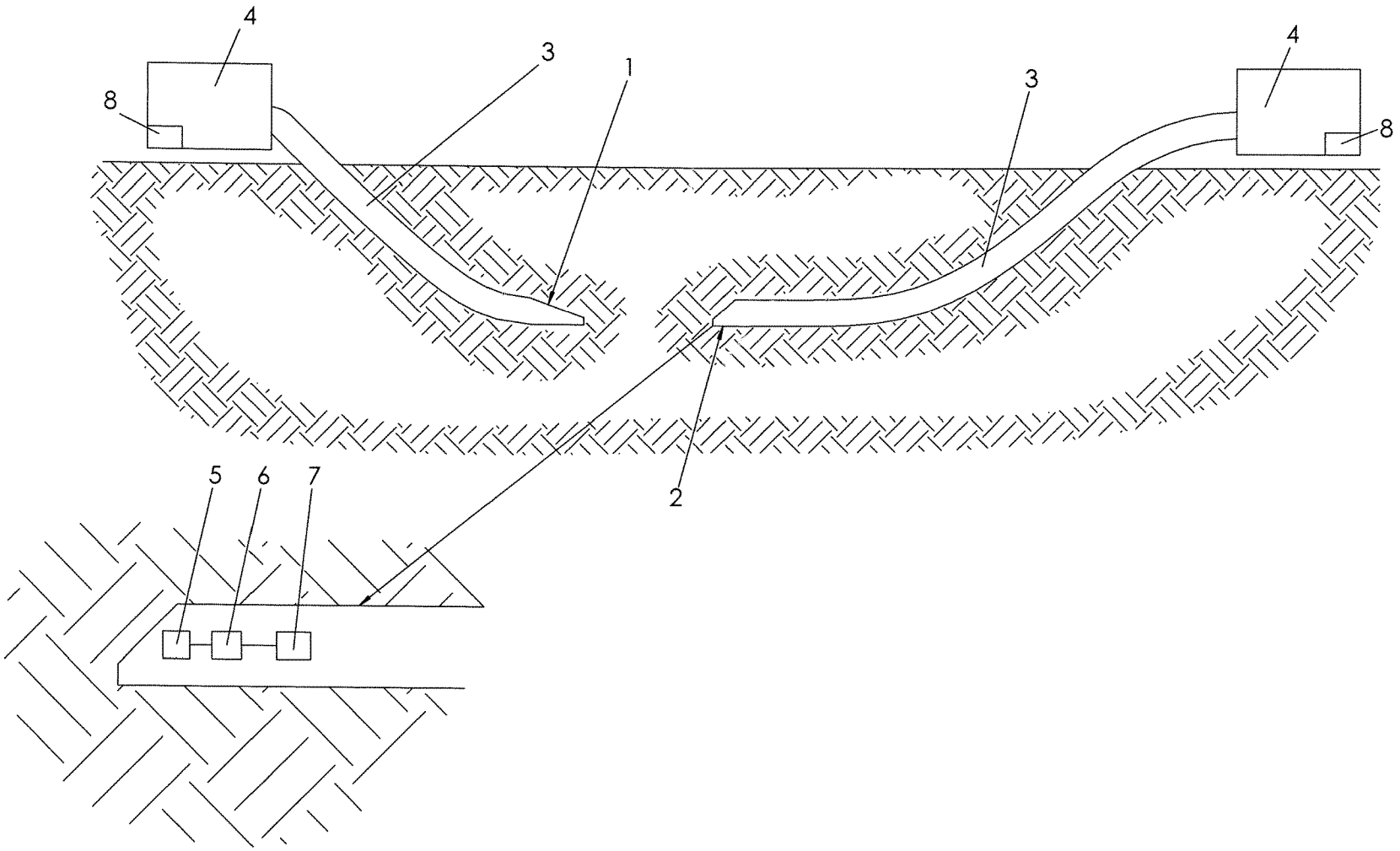
8
4
3
1
3
4
8
2
7
6
5

METHOD FOR INTRODUCING A BOREHOLE INTO THE SOIL AND SOIL DRILLING DEVICE AND USE THEREOF

CROSS-REFERENCE TO RELATED APPLICATIONS

This application claims priority pursuant to 35 U.S.C. 119(a)-(d) to German Application No. 10 2016 002 479.8 filed Mar. 3, 2016, the entire contents of which is incorporated herein by reference for all purposes.

FIELD OF THE INVENTION

The invention relates to a method for introducing a borehole into the soil with two converging drill heads and a soil drilling device with a drill head.

BACKGROUND OF THE INVENTION

Convergence boring is known, wherein two soil drilling devices each construct a borehole, with the alignment relative to one another being such that a continuous borehole should be produced, which the two boreholes thus meet at at their respective target section (endpoint). The to-date attainable "accuracy" in convergence boring is limited and associated with high costs. A to-date attainable "accuracy" of +/−0.5 meters appears to be sufficient at first glance, however, if the two boreholes do not join together in a precise manner, it is not possible for example to insert a pipe into the resulting borehole. This is why multiple, often three to eight, corrective boreholes have previously been required in the target section. Convergence boring is thus time-consuming and expensive.

In order to increase the accuracy, on the one hand it has previously been proposed to carry out a locating of the drill heads using strong artificial magnetic fields and/or artificial magnetic target points (so-called "beacons" for land-based use and "benchmarks" for underwater use). The provision of the artificial magnetic fields or artificial magnetic target points necessitates an additional measure, which has to be realized prior to the boring. The artificial magnetic fields or artificial magnetic target points must be introduced at predetermined locations, which also involves significant effort. In addition, the artificial magnetic fields and/or magnetic target points may need to be removed from the soil again. On the other hand, it has previously been proposed to carry out a respective locating of the two drill heads used by means of suitable systems, for example, a high-precision optical gyroscope system. With the gyroscope system in a drill head it is possible to determine where the drill head is currently located. Such a system is expensive and there is still a risk with respect to the axis- and level-identical alignment of the two drill heads relative to one another specifically in the region of the target section, so that this system too is associated with outlay in the form of time and corrective measures, which is also expensive.

SUMMARY OF THE INVENTION

The invention addressed the problem of creating an improved method for introducing a borehole into the soil with two converging drill heads, which method is simply constructed and/or reduces the outlay in the form of time and corrective measures for convergence boring. With the converging drill heads, initially a respective (partial) borehole is constructed, which forms a continuous borehole when the two (partial) boreholes meet. In addition, a soil drilling device is to be disclosed, by means of which improved convergence boring can be achieved.

The idea behind the invention is that at least one of the two drill heads detects the other drill head and, on the basis of the detection of the other drill head, at least one of the two drill heads has its direction of advance adapted relative to the other drill head. The fundamental idea is thus that, in order for the convergence boring to be successful, it is not primarily the location, position and/or alignment of the drill head itself that is important, but rather the location, position and/or alignment of the other drill head. The alignment does not take place based on a predetermined path which has to be reached, but rather based on the detected location, position and/or alignment of the other drill head, which is/was also moved in order to realize the convergence boring. The adaptation of the direction of advance of at least one of the two drill heads thus takes place based on a non-statistical reference point outside of the at least one drill head, which represents a departure from the previous accuracy-increasing methods.

The invention provides a method for introducing a borehole into the soil with two converging drill heads, which can each construct a partial borehole. In the method, one of the two drill heads is detected by means of a detection device on the other drill head and, according to the detected drill head, the direction of advance of at least one of the two drill heads is adapted relative to the other drill head. This means that, in response to the detection of the other drill head, the adaptation of the direction of advance towards one another can be realized. At least one of the two drill heads which are boring towards one another is aligned with the other (moving or having executed a movement) drill head of the two drill heads.

According to the invention, the term "drill head" comprises a front-side region of a drill pipe of a soil drilling device. A "soil drilling device" shall be understood to mean in particular any device which moves a drill pipe having a drill pipe length in a conduit to be constructed in order to construct or enlarge a borehole, in particular a horizontal borehole, or in order to lay lines or other long bodies in the soil. The soil drilling device can in particular be a HD (horizontal drilling) device. A "soil drilling device" according to the invention comprises a device driving a drill pipe, which operates in a soil displacing manner, and the drill pipe can be driven at least over a partial angular range rotating in the longitudinal axial direction of the drill pipe. According to the invention, the term "HD" comprises a borehole, which extends essentially horizontally or which can be a borehole which is inclined relative to the horizontal.

The drill head can in particular be a drill head in which nozzles are provided, through which drilling fluid can be discharged into the soil in the region around the drill head. In particular, a drilling fluid which contains bentonite, preferably in the form of particles, can be used. The drilling fluid can be pressurized, so that the pressurized drilling fluid can discharge from the nozzles on the drill head. Thanks to the drilling fluid, a loosening of the soil in the region around the drill head can occur. The drilling fluid discharging from the drill head, which can be pressurized, can loosen the soil. The soil drilling device can have a suitable pump for pressurizing the drilling fluid. In order to supply the drilling fluid to the drill head, the drill pipe, which connects the soil drilling device to the drill head, can have a conduit by means of which the drilling fluid is transported to the drill head for example from a storage container, which can in particular be arranged at the surface.

In one preferred embodiment, the detection unit is designed such that it permits emission and reception of electromagnetic radiation. The detection unit can be part of a unit for emission and reception of electromagnetic radiation. The detection unit can also be separate from a unit for emission and reception of electromagnetic radiation. According to the invention, "electromagnetic radiation" comprises any electromagnetic wave, in particular radar waves, so that the detection unit can be formed as a radar. A radar makes it easy to detect the outer contour of other objects in the soil. In particular, a radar antenna allows the detection of the form and location of another drill head because the other drill head is easily detectable due to the intense reflection of the metal thereof. In particular, the distance from the other of the two drill heads can be easily determined.

In one preferred embodiment, in particular the front contour of the other drill head can be determined. For this purpose, at least one of the following parameters of the other drill head describing the location of the front contour can be detected: pitch, roll (tool face position), axis (level-alignment and side-alignment). The detection of at least one of the above parameters allows precise convergence boring by permitting axis- and location-precise convergence.

In one preferred embodiment, one of the two drill heads can, after slow retraction of the other, enter precisely and without deviation into the borehole of the retracting drill head and in particular pass through same. This permits a joint borehole widening and a joint pipe or cable insertion. This can for example make long boreholes possible, which can be bored with relatively small soil drilling devices and therefore inexpensively.

In one preferred embodiment, the rock loosening zone in front of the drill head is detected by means of the detection unit.

The term "rock loosening zone" comprises a region in front of the drill head, in which a drilling fluid discharging from the drill head causes a loosening of the soil located in front of the drill head. The drilling fluid can discharge from the drill head by means of nozzles formed in the drill head. The drilling fluid can be pressurized such that a (high) pressure drilling fluid circulation occurs and a rock loosening zone in front of the drill head is formed. A hydromechanical power output element is used when advancing into the loose rock, which the mechanical element can then penetrate more easily. The area of the rock loosening zone, in other words, a hydromechanical loosening zone, is usually in the region of a few centimeters, in particular 7 to 17 centimeters, preferably 10 centimeters to 15 centimeters. Although it was assumed that a detection of one of the two drill heads by means of the other drill head in the rock loosening zone in front of the drill head could be difficult due to the drilling fluid used, which can in particular contain bentonite in the form of bentonite particles, since the bentonite particles could have a shielding effect, it is nevertheless possible to detect the drill head according to the invention. In particular electromagnetic radiation, preferably radar waves, permit a penetration into the region in front of and to the side of the drill head of several decimeters to several meters. Radar waves in particular detect by means of reflection (return of the wave signals) foreign objects and density differences in the earth, meaning that they can thus also identify the location of previous pipeline trenches, can show clay intercalation and clay seams, can identify the surface of the groundwater and can identify in a precise manner for example thanks to particularly intense reflection of intercalated metal elements (metal pipes; foreign drill pipes). In particular another drill head, which approaches the drill head as here in convergence boring, can be detected with "razor-sharp" accuracy so that, on the one hand, the contour can be depicted and the distance of the drill head can also be determined.

In one preferred embodiment, a pattern detected by the one of the two drill heads can be compared with a comparison pattern. According to the invention, the term "pattern" comprises a contour of the detected drill head, with the contour in particular comprising the drill head front of the drill head. The comparison pattern can be a pattern stored in a storage means, which pattern describes the other drill head which is detected in a predetermined position or predetermined positions. In particular, a computer unit, in the form of a (mini) computer or another unit, can be additionally provided or integrated into the detection unit, which computer unit processes data by means of programmable rules. It can be provided that the detection unit is designed such that the pattern can be formed by the detection unit from the reflected signals and compared with at least one of the patterns stored in the storage means. However, it can also be provided that the data of the detection unit is transmitted to a unit arranged in the drill string or to a unit arranged above ground, with the unit in the drill string or the unit arranged above ground being able to comprise the computer unit. The unit can be the machine control console of the soil drilling device. The term "above ground" also comprises the arrangement in an access trench or target trench. Software for pattern recognition can be installed in the computer unit, by means of which software patterns of the detected drill head are compared with one or more comparison patterns. The detected drill head can thus be located in a positionally-accurate manner and side and/or height deviations can be detected. The direction of advance of at least one of the two drill heads can be adapted, for example when predetermined deviations between the detected pattern and the comparison pattern or comparison patterns are exceeded. An automatic adaptation or an adaptation initiated by the machine operator of one of the two soil drilling devices can then be realized, by transmitting the exceeding of the predetermined deviation to the machine control console and correction thereof by the machine operator by means of counteraction commands at an orientation unit or by generation of an automatic control (e.g. based on fuzzy logic) of such counteraction commands without human intervention and transmitted to an orientation unit of the machine control console.

In one preferred embodiment, the two drill heads can be aligned with one another. Both drill heads can thus experience a convergence and optimization with respect to the convergence boring. The method according to the invention can thus be realized in that not just one of the two drill heads has a detection unit but both drill heads.

The invention also provides a soil drilling device with a drill head, in which a detection unit is provided, which detects the alignment of at least one other drill head. The soil drilling device also has an orientation unit, by means of which the drill head can be aligned with its direction of advance relative to the other drill head.

In one preferred embodiment, the detection unit has a unit for pattern recognition, by means of which the other drill head which is to be recognized can be easily identified.

The invention also provides a use of a detection unit in a drill head, with the drill head being designed for boring in soil. The detection unit is used to detect another drill head and to align the direction of advance of the drill head relative to the other drill head.

The above statements and the following description of exemplary embodiments do not rule out specific embodiments or features.

BRIEF DESCRIPTION OF THE DRAWINGS

The invention is explained in greater detail below with reference to an exemplary embodiment depicted in the drawing.

FIG. 1 shows an introduction of a borehole into the soil with two converging drill heads.

DETAILED DESCRIPTION

FIG. 1 shows an introduction of a borehole into the soil by means of two drill heads 1, 2. The drill heads 1, 2 are connected to a drill pipe 3 or drill string, which consists of a plurality of drill pipe lengths connected to one another. The drill pipe lengths are connected to one another along the course of the bore. The drill heads 1, 2 are advanced and (temporarily) rotatively driven by means of the drill pipe 3 of a driving device 4 arranged on the earth's surface. The rotary driving on the one hand serves to improve the advancement of the drill heads 1, 2 in the soil and on the other hand a control function is thereby achieved in conjunction with the formation of at least one of the two drill heads 1, 2 as a slanted drill head. When the drill head 1, 2 designed as a slanted drill head is advanced through the soil, the slanted surface of the drill head 1, 2 creates a deflection, the effect of which is offset across a full rotation of the drill head 1, 2. If the drill heads 1, 2 which are designed as slanted drill heads are thus continuously rotatively driven during the advancement, the soil drilling device bores straight ahead. A reorientation of the soil drilling device occurs by stopping the drill heads 1, 2 and driving them forwards at the same time in a defined direction, i.e., a certain location of the slanted surface of the drill heads 1, 2 (the so-called "roll angle"). The deflection created by the slanted surface then results in a curved bore course. This process is continued until the desired new boring direction is obtained. The rotary drive is subsequently reactivated in order to continue boring straight ahead.

In the exemplary embodiment depicted in FIG. 1, each of the two drill heads 1, 2 has a radar unit 5, which is arranged behind or in the slanted surface of the drill heads 1, 2. A detection area is thus defined, which (partially) extends ahead of the drill head 1, 2. The drill heads 1, 2 each have a detection unit 6 which is functionally connected to the radar unit 5.

The radar unit 5 can be a radar designed as a combined front and side radar, which emits electromagnetic waves bundled as primary signals and receives the signals reflected from objects as secondary signals.

The detection unit 6 analyzes the reflected (secondary) signals of the radar unit 5 in order to obtain information about the objects, with the outer contour of the detected objects being detected in particular. This allows the analysis in particular of the radar waves reflected from the drill head front of the respective other drill head 1, 2 by means of pattern recognition software which is installed in a computer unit 7 in the respective drill head 1, 2. The pitch, roll, side deviation and/or height deviation of the other drill head 1, 2 can be detected by means of the pattern recognition software. One or more comparison patterns for the drill head 1, 2 is stored in the storage means of the computer unit 7 for the comparison.

The direction of advance of at least one of the two drill heads 1, 2 is adapted when a predetermined deviation between the detected pattern and the comparison pattern or comparison patterns is exceeded. Two adaptations are possible with the embodiment depicted in FIG. 1. On the one hand, an automatic adaptation can be carried out in that, in response to the comparison of the computer unit 7, commands are generated which are transmitted to the machine control console of the soil drill device (driving device 4) in order to adapt the direction of advance at an orientation unit 8 of the driving device 4 of at least one of the two drill heads 1, 2. The adaptation can be displayed on a display of the driving device 4. However, it is also possible that the result of the comparison is—without automatic adaptation—displayed to a machine operator of the driving device 4 of one of the two drill heads 1, 2, for example on a display of the driving device 4, and that the machine operator himself undertakes the adaptation of the direction of advance by means of an orientation unit 8.

The invention claimed is:

1. A method for introducing a continuous borehole into the ground with converging drill heads, comprising:

drilling, with a first drill head, in a first direction and forming a first portion of the continuous borehole;

drilling, with a second drill head, in a second direction distinct from the first direction and generally advancing towards the first drill head and forming a second portion of the continuous borehole;

detecting, by a detection unit in the first drill head, an orientation parameter of the second drill head; and responsive to the detecting of the orientation parameter of the second drill head, adapting at least one of the first direction of the first drill head relative to the second direction of the second drill head and the second direction of the second drill head relative to the first direction of the first drill head, so that further advance in the first direction and the second direction is towards a meeting of the first portion of the continuous borehole and the second portion of the continuous borehole to form the continuous borehole.

2. The method according to claim 1, wherein the detecting comprises emission and reception of electromagnetic radiation by the detection unit.

3. The method according to claim 2, wherein the emitting and receiving of electromagnetic radiation comprises emitting radar waves and receiving reflected radar waves by the detection unit.

4. The method according to claim 1, wherein the orientation parameter comprises a pitch of the second drill head.

5. The method according to claim 1, wherein the orientation parameter comprises a roll of the second drill head.

6. The method according to claim 1, wherein the orientation parameter comprises at least one of a height deviation and a side deviation of the second drill head.

7. The method according to claim 1, further comprising comparing, by a computer unit of the first drill head, a detected received pattern indicative of a contour of the second drill head with a stored comparison pattern indicative of a contour of a drill head, and, based on the comparing, output one or more of a pitch, roll, side deviation and height deviation of the second drill head.

8. The method according to claim 1, wherein the adapting comprises aligning the first and second drill heads.

9. The method according to claim 1, further comprising detecting, by the detection unit, a rock loosening zone in front of at least one of the first drill head and the second drill head.

10. The method according to claim 1, further comprising retracting the second drill head from the second portion of the continuous borehole and advancing the first drill head underground in the first portion of the continuous borehole and into a distal end of the second portion of the continuous borehole formed by the second drill head.

11. A soil drilling device, comprising:

a first drill head configured to drill in a first direction and form a first portion of a continuous borehole;

a detection unit arranged within the first drill head, configured to detect an alignment of a second drill head configured to drill in a second direction and form a second portion of the continuous borehole;

an orientation unit in communication with the detection unit, and configured to, responsive to the detected alignment of the second drill head, modify a direction of advance of the first drill head to a direction generally advancing toward the second drill head towards a meeting of the first portion of the continuous borehole and the second portion of continuous borehole to form the continuous borehole.

12. The soil drilling device of claim 11, further comprising a computer unit configured to compare a pattern indicative of a contour of the second drill head detected by the detection unit with a stored comparison pattern indicative of a contour of a drill head.

13. The soil drilling device of claim 12, wherein the computer unit is further configured to, based on the comparing, output one or more of a pitch, roll, side deviation and height deviation of the second drill head.

14. The soil drilling device of claim 12, wherein the computer unit is further configured to detect at least one of a height deviation and a side deviation of the second another drill head.

15. The soil drilling device of claim 12, wherein the direction of advance is adapted responsive to exceeding of a predetermined deviation between the detected pattern and the comparison pattern.

16. The soil drilling device of claim 11, wherein the detection unit comprises a radar emitter and receiver.

17. The soil drilling device of claim 11, wherein the first drill head comprises at least one slanted surface for engaging with and advancing through soil.

18. A method for introducing a continuous borehole into the ground with converging drill heads, comprising:

drilling, with a first drill head, in a first direction and forming a first portion of the continuous borehole;

drilling, with a second drill head, in a second direction distinct from the first direction and generally advancing towards the first drill head and forming a second portion of the continuous borehole;

detecting, by a detection unit associated with the first drill head, an orientation parameter of the second drill head;

responsive to the detecting of the orientation parameter of the second drill head, adapting at least one of the first direction of the first drill head relative to the second direction of the second drill head and the second direction of the second drill head relative to the first direction of the first drill head, so that further advance in the first direction and the second direction is towards a meeting of the first portion of the continuous borehole and the second portion of continuous borehole to form the continuous borehole; and retracting the second drill head from the second portion of the continuous borehole and advancing the first drill head underground in the first portion of the continuous borehole and into a distal end of the second portion of the continuous borehole formed by the second drill head.

19. The method according to claim 18, further comprising the step of comparing, by a computer unit of the first drill head, a detected received pattern indicative of a contour of the second drill head with a stored comparison pattern indicative of a pattern of a drill head, and, based on the comparing, output one or more of a pitch, roll, side deviation and height deviation of the second drill head.

20. The method according to claim 18, wherein the step of detecting comprises emission of electromagnetic radiation by the detection unit and reception of reflections of the emitted electromagnetic radiation by the detection unit.

* * * * *